United States Patent [19]

Stanik et al.

[11] 4,017,945

[45] Apr. 19, 1977

[54] FASTENER FOR POCKETS, CASES OR THE LIKE

[75] Inventors: Raimund Stanik, Wuppertal-Beyenburg; Horst Gustav Appelt, Wuppertal-Barmen; Walter Ramspott, Wuppertal-Elberfeld, all of Germany

[73] Assignee: Firma Schaeffer-Homberg GmbH, Wuppertal-Barmen, Germany

[22] Filed: July 28, 1975

[21] Appl. No.: 599,761

[30] Foreign Application Priority Data

Sept. 28, 1974 Germany ..... 2446469

[52] U.S. Cl. ..... 24/208 R; 24/DIG. 17; 24/217 R; 24/213 R

[51] Int. Cl.[2] ..... A44G 17/00

[58] Field of Search ..... 24/213 R, 214, 220, 24/DIG. 17, 73 P, 73 PF, 208 R, 216, 217

[56] References Cited

UNITED STATES PATENTS

| | | | |
|---|---|---|---|
| 371,975 | 10/1887 | Rhodes | 24/214 |
| 662,844 | 11/1900 | Weidmuller | 24/214 |
| 2,909,957 | 10/1959 | Rapata | 24/213 R |
| 3,769,661 | 11/1973 | Bengtsson | 24/DIG. 17 |
| 3,831,225 | 8/1974 | Bengtsson | 24/73 P |
| 3,893,208 | 7/1975 | Yuda | 24/73 P |
| D25,117 | 2/1896 | Raymond | 24/213 R |

FOREIGN PATENTS OR APPLICATIONS

| | | | |
|---|---|---|---|
| 855,639 | 5/1940 | France | 24/214 |
| 342,451 | 8/1936 | Italy | 24/213 R |

*Primary Examiner*—Bernard A. Gelak
*Attorney, Agent, or Firm*—Martin A. Farber

[57] ABSTRACT

A fastener in the form of a release fastener, snap fastener and the like for pockets, cases and the like, also comprising a female part formed with an insert opening. A closing head operatively releaseably lockingly engages in the insert opening, and a male holding part carries the closing head. The closing head is formed with a rearward collar supported on the male holding part, with the closing head extending through a hole in the male holding part, and including a plug-in snap-catch connection between the male holding part and the closing head.

15 Claims, 27 Drawing Figures

FIG. 13
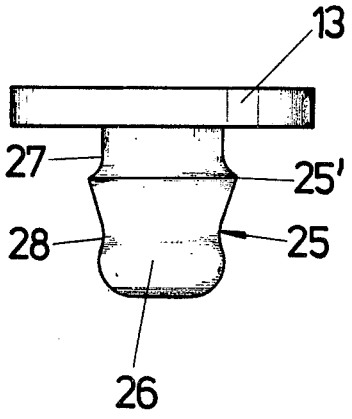
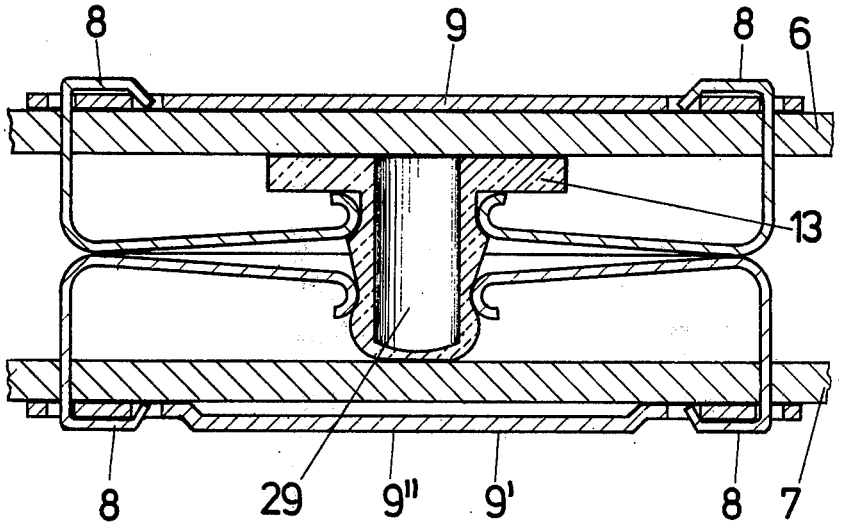
FIG. 14

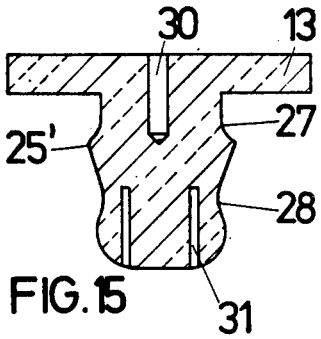
FIG. 15
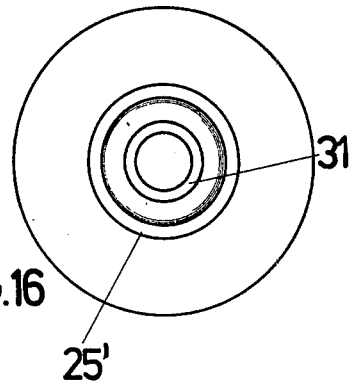
FIG. 16
FIG. 17
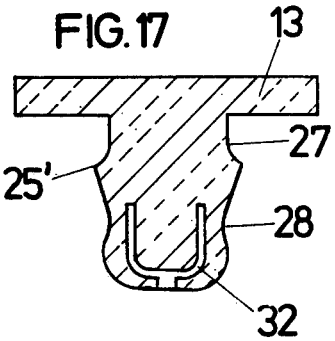
FIG. 18
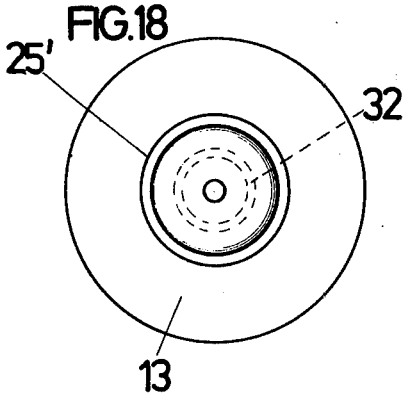
FIG. 19
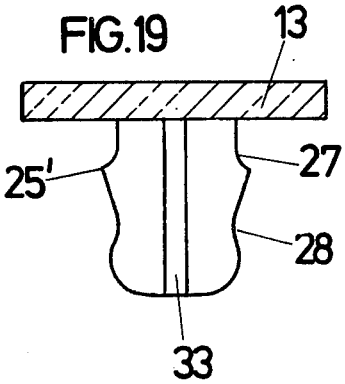
FIG. 20
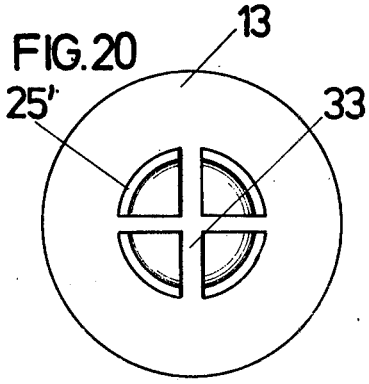

FASTENER FOR POCKETS, CASES OR THE LIKE

The present invention relates to a fastener for pockets, cases or the like, constructed in the form of a releasable fastener, snap fastener or the like comprising a female part having the closing head insertion opening and a male part carrying the closing head, the latter being supported on the male holding part with a rearward collar and extending through a hole of the male holding part.

The known fasteners of this type have the disadvantage of a large number of construction parts. For example, it is known to fix the closing head of the male part on the male holding part by means of an abutment plate, whereby this spring plate deforms, or braces, the collar of the fastener button from the rear side against the edge of the hole of the male holding part. In order to attain the engagement of the closing head with the female part, it is known to provide spring structural members on the female part which project into the range of the closing head insert opening and which after insertion of the closing head resiliently grip its holding shoulder from behind. In addition to the disadvantage of a relatively large number of structural members, whereby expensive manufacture, storage and assembly arise, also a secure manner of operation very quickly is impaired by external influences, such as, for example corrosion, dirt and the like.

It is an object of the present invention, particularly, that is, in addition to that gathered from the specification and claims, to form an advantageously usable fastener of th introductory-mentioned type with simpler manufacturing technique and in a sturdy manner, such that with the smallest number of of construction parts an optimum security of use is guaranteed, and beyond that, advantages are offered with respect to assembly and storage, as well as production.

This task is achieved in accordance with one object of the invention by providing in a fastener of the introductory-mentioned type, a plug-in snap-catch connection between the male holding part and the closing head, or furthermore with other cooperative features set forth herein.

As a result of the present invention, a fastener is provided having an increased service life. The simple plug-in snap-catch connection between the male holding part and the closing head brings not only an economization of construction members but rather even makes possible beyond this an assembling of the fastener head without tools. The closing head fulfils two tasks, namely, on one hand to fasten itself on the male holding part, and on the other hand to catch lock the female part. The thereby achieved catch locking engagement between the male holding part and the closing head is of very great stability, so that any counter holder means is unnecessary. In view of the slideability and resiliency characteristics, any convenient material, such as, for example, crystalline synthetic material, can be used for the closing head. This results in an improved resistance to wear. The snap-catch connection is chosen in a favorable manner in the immediate vicinity of the closing head pin so that the holding forces act with the smallest leverage or moment. The closing head pin thereby is so favorably formed that by its form alone, different holding forces are attained in the "assembly catch" as well as in the "fastening catch" ; that is, the forces which are required to bring about the catch locking engagement between the closing head and the female insertion opening are smaller that the catch retaining forces between the closing head and the male holding part. This is achieved in a simple way, in that zone separating the two catch grooves from each other has a larger cross-section than the closing head. With the plug-in snap-catch connection between one of the catch grooves and the edge of the male holding part, the cross-sectionally larger center zone between the catch grooves must be pressed with larger force exertion through the opening in the male holding part than is necessary for the catching engagement of the cross-sectionally smaller closing head portion opposite the center zone in the insertion opening of the female part. Also in no way are spring construction parts needed on the female part for providing a resilient catch locking engagement, by means of the special formation and material selection of the closing head. Further, the female part and the male holding part can be totally formed alike, such that with respect to storage amd manufacture, considerable simplifications are achieved. The female holding part and the male part are also advantageously formed with respect to the catch locking engagement, in that the respective facing front sides are formed trough shaped. In this manner a pretensioning can be achieved by the catch locking engagement between the male part and the female part, whereby both parts lie against each other without play under spring action. By means of these measures, a penetration, for example, of dirt, humidity vapor, etc., is extensively avoided. Also the trough shape makes the joining of the parts easier. In order to provide softer locking, the closing head pin in advantageous way can have recesses in the range of one or both catch groves. By means of different sized recesses in the corresponding catch ranges, the gentle, yet secure, locking forces attained by these recesses permit differing catch locking engagement forces to be achieved in the range of the two catch grooves, respectively, independent of the cross-section dimensions of the center zone and of the closing head. However, also a combination is possible in which by means of a uniform extending, single recess, the catch locking forces can be held gentle, and the different catch forces furthermore can be attained by means of different cross-sections of the closing head as well as the center zone. It also permits a favorable embodiment of the closing head pin to be attained such that a plug-in snap-catch connection is possible from the front side of the male part. The catch sections can thereby even in an advantageous way be symmetrically kept by the outer shape starting outwardly from the center zone of greater cross-section, whereby differences occur for different catch locking engagement forces, merely by the corresponding dimensioned recesses. This embodiment makes it possible to provide a male holding part as well as a female part yet for example on a flat case or folder, and only subsequently to assemble the closing head on the male holding part.

This makes an advantageous assembling possible under circumstances. It is even possible, by means of an advantageous manner of manufacture, to arrange the recesses of the closing head pin in a concealed position, that is, with the outer surfaces of the closing head pin completely closed. This is possible in a simple manner, for example, in an injection moulding process with synthetic material, in which individual sections of the closing head pin are individually injection moulded, and during the common assembly are pressed undetachably against each other in the longitudinal center plane by the forces which occur by the plug-in catch connection. It permits however the individual sections of the closing head to stand in connection with each other by means of stays of material, which is made possible after cooperatively folding the half-parts in spite of a joint assembly.

With the above and other objects in view, the present invention will become more readily understood in connection with the detailed description with respect to the accompanying drawings, of which:

FIGS. 13–20 show other embodiments of a differently formed closing head pin, with FIG. 13 being an elevational view, FIG. 14 a longitudinal cross-section through a complete fastener in locked position, and FIGS. 15–16, 17–18, and 19–20, respectively, longitudinal cross-section and bottom views, respectively, of three variational embodiments;

Figure 1:
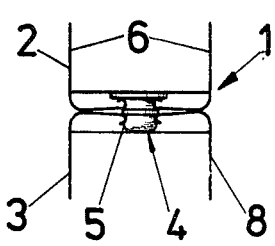
FIG. 1 is a schematic elevational view of a fastener in accordance with the present invention in the form of a release or zip type fastener.
Figure 2:
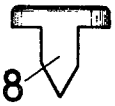
FIG. 2 is a side view of one part of the fastener of FIG. 1.
Figure 3:
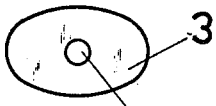
FIG. 3 is a plan view of the female part of the fastener of FIG. 1.
Figure 4:
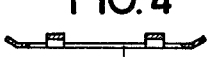
FIG. 4 is an elevational view of a counter retainer plate.
Figure 5:
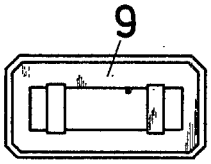
FIG. 5 is a plan view of FIG. 4.
Figure 6:
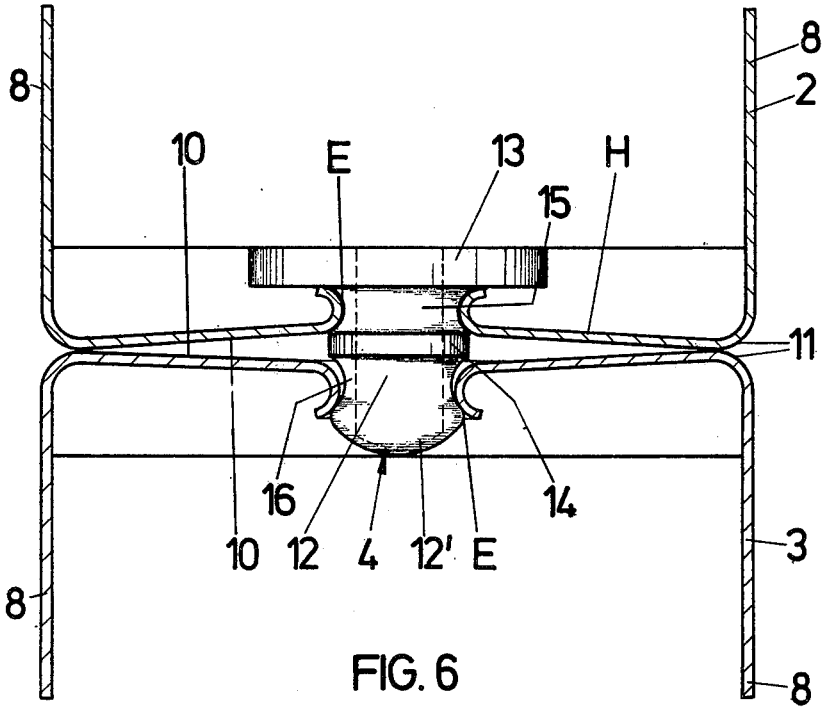
FIG. 6 is an enlarged elevational view corresponding to that of FIG. 1.

Referring now to the drawings, and more particularly to FIGS. 1–6, a fastener 1 in accordance with the present invention comprises two female type members 2, 3, constituting a male part 2 and a female part 3. The male part 2 here has a closing head 4 which can snap in an insert opening 5 in the female part.

The male part 2 and the female part 3 have attaching means constituting retainer claws 8 for fastening on corresponding material sections 6, 7 (e. g., as in FIG. 14) of a pocket, for example. The retainer claws penetrate the pocket material and are held on the opposite side thereof by a counter retainer plate 9 by being bent back passing through two openings in the counter retainer plate, respectively.

The counter retainer plate 9 can here be planar, whereby the bent back sections of the claws project yet beyond the plane of the counter retainer plate; it is also possible to form the center range 9'' of a counter retainer plate 9' with an elevated section, so that this elevated section 9'' lies on a plane with the bent sections of the retainer claws 8.

The male part 2 and the female part 3 are completely formed alike, whereby both parts have a central insertion opening 5, E, the opening edge of which is inwardly arcuately flanged. Further, the facing front sides 10 of the male part 2 and of the female part 3 widen toward the openings E, such that a trough is formed therebetween and both parts 2, 3 abut against each other simply in the range of their outer edge 11, this under spring biasing of the trough sections which stand pretensioned. The inwardly flanged zone of the edge of the opening can have transverse slots in order to improve the resiliency and/or the spring adjustment.

The completely like formed parts 2, 3 can selectively serve as the female part 3 or as the male holder part H, which in connection with the closing head 4 constitutes the male part.

The closing head comprises a closing head stud or shank pin 12 and a collar 13. In the center range of the closing head pin 12, there is provided a cross-sectionally widened zone 14. An annular convex catch engagement groove 15 and 16, respectively, of the closing head pin 12 each is joined to both sides of the cross-sectionally enlarged zone 14. The engagement grooves 15, 16 serve for the cooperatively catch locking engagement with the substantially complementary bent around arcuate inner edges of the insertion holes E.

The assembly of the closing head 4 on the male holding part H is brought about in the manner that the closing head is pressed in rearwardly relative to the male part H into the hole E thereof, and after two snap catches, a plugged-in snap-catch connection is reached between the bent around edge of the hole E and that engagement groove 15 which lies adjacent the collar 13. The front freely projecting section of the closing head pin 12 which carries the other catch engagement grove 16 serves for a releasable catch locking engagement with the female part 3.

In order to keep the catch locking engagement forces of the releaseable catch locking engagement with the female part, small with respect to the retaining catch engagement with the male holding part, the front section 12' of the closing head pin 12 is kept smaller in cross-section relative to the center zone 14.

For achieving these different engagement forces, as well as softer or more yieldable closings, several embodiments of the present invention are illustrated.

Figure 7:
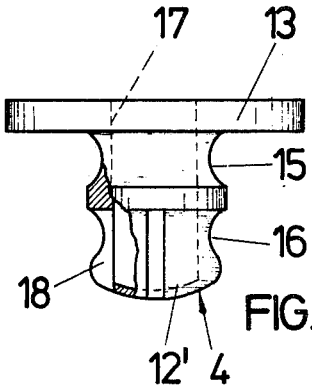
FIG. 7 is an elevational view of another embodiment of the closing head in accordance with the invention, partly broken away in section.
Figure 8:
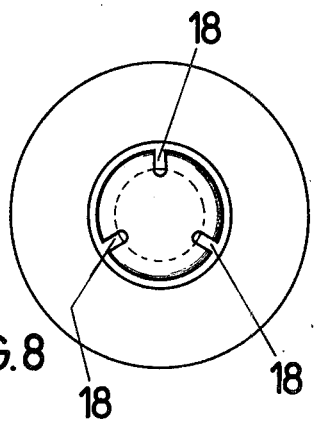
FIG. 8 is a bottom view of FIG. 7.

FIGS. 7 and 8 show a closing head which has a hollow cavity 17 centrally passing through the closing head pin well as the collar 13, which cavity however terminates before the end 12' of the closing head pin. This cavity 17 generally causes a softer locking engagement, whereby the engagement forces in the range of the groove 16 which serve for the releasable connection with the female part, still additionally are reduced by radial slits 18. The radial slits 18 however do not extend upto the center point of the circular formed pin cross-section.

Figure 9:
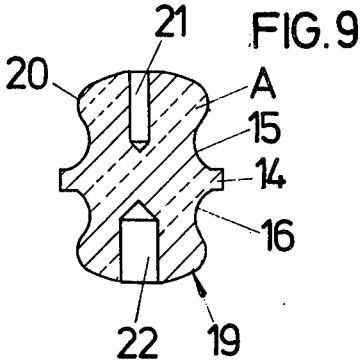
FIGS. 9 and 10 are longitudinal cross-sectional and bottom views, respectively, of still another embodiment of the closing head.
Figure 10:
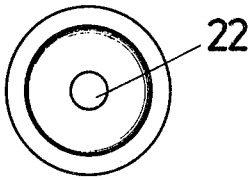

FIGS. 9 and 10 show another closing head 19 which is symmetrical in its external shape starting from the cross-sectionally widened center zone 14. The sections of the closing head pin which point outwardly, following on the engagement grooves 15, 16 are uniformly formed, with the section A engaged with the male holding part having a collar formed simply as a bead 20 which facilitates the assembly from the front side. The different engagement forces in this embodiment of the invention are achieved by means of bores 21, 22 which are dimensioned of different sizes and are longitudinally provided centrally through the two catch engagement sections of the grooves 15, 16, respectively.

Figure 11:
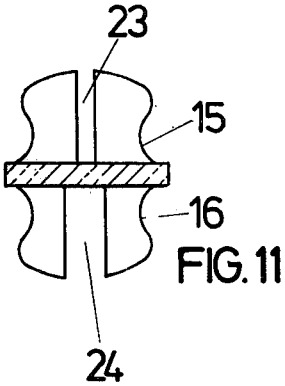
FIGS. 11 and 12 are longitudinal cross-sectional and bottom views, respectively, of yet another embodiment of the closing head.
Figure 12:
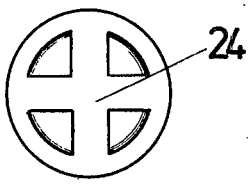

By the embodiment according to FIGS. 11 and 12, the different engagement forces are achieved by cross slots 23, 24, whereby the slots of the two catch engagement sections 15, 16 are dimensioned with different widths.

FIGS. 13 to 20 show further embodiments of the invention of the form of the closing head, which are here designated with the reference numeral 25. The closing head pin 26 hereby also has engagement catch sections 27, 28 formed by annular concave grooves; however, the transition section from the groove 27 to the groove 28 has a frustoconically shaped narrowing cross-section, the widest point of which here forms the cross-sectionally enlarged zone 25′ . The increasing slope formed by the truncated cone facilitates an assembly of the closing head with small forces, and at the same time makes an unintentional release more difficult by the strong step or grade of the catch portion. Also the form of this embodiment can bring about a softer or gentler catch locking engagement by means of a central cavity 29 (FIG. 14); however, also here different forces can be achieved in the two catch locking engagement sections 27, 28.

This, for example as FIGS. 15 and 16 show, can be attained in the manner that a bore 30 starts from the collar 13 and extends upto the range of the engagement groove 27, and on the opposite free end of the pin 26 which has the engagement section 28, an annular recess 31 is provided.

This annular recess, as shown in FIGS. 17 and 18, also can be formed as a hidden annular recess 32.

As shown in the embodiment of FIGS. 19 and 20, furthermore the possibility exists to equip the closing head 25 with cross slots 33 in the entire range of the pin 26.

Figure 21:
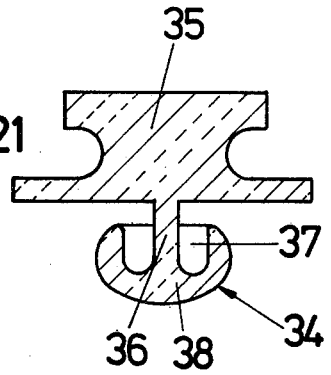
FIG. 21 is a longitudinal view of still another embodiment of a closing head pin of the invention.

Referring now again to the drawings, the embodiment shown in FIG. 21 comprises a closing head 34, which has a compact retaining catch section 35 for the engagement with the male holding part H, the section 35 projecting beyond a stay of material 36 in a mushroom shaped section 38 formed from the inside outwardly with an annular cavity 37 which is set for the releasable catch locking engagement with the female part.

Figure 22:
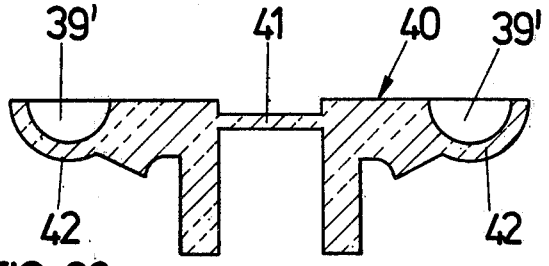
FIG. 22 is a longitudinal cross-sectional view of a divided closing head-pin.
Figure 23:
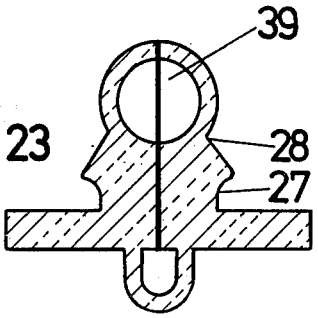
FIG. 23 is a longitudinal cross-sectional elevational view of the closure head pin of FIG. 22 folded together.

FIGS. 22 and 23 illustrate another embodiment showing a possibility of providing the closing head with a spherical shaped inner cavity 39 and keeping the external surface completely closed. The closing head which is produced as an injection molded part possesses hereby completely equal half-parts which are connected with each other by means of a web 41 of material. The half-parts each are formed with a semi-spherical recess 39′ . These two half-parts 42 are folded against each other, whereby the semi-spherical shaped recesses 39′ cooperatively complement each other to form the completed spherical cavity 39. The half-parts which are folded against each other can be held to one another, for example, by any suitable adhesive substances; however, after insertion of a non-adhered closing head into the male holding part, even the catch locking force is sufficient in order to hold the two half-parts to one another.

Figure 24:
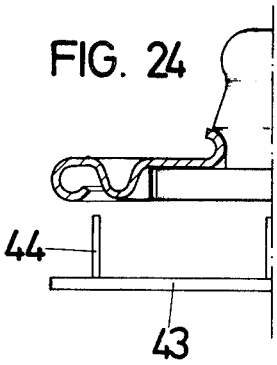
FIG. 24 is a partially broken away exploded elevational view indicating a connection between the male part and the female part, respectively, and the counter retainer plate for use in cooperation with the invention.
Figure 25:
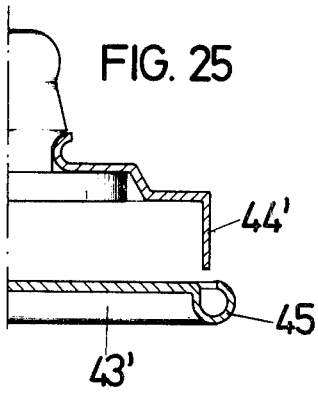
FIG. 25 is a partially broken away exploded elevational view of a variation of FIG. 24.

FIGS. 24 and 25 illustrate still other embodiments of the invention for connection of the male part and the female part, respectively, to the counter holding plate. In the embodiment as shown in FIG. 24, the male part (as well as the identically formed female part —not shown) has an inwardly bent around outer edge, in which, through the intermediate sandwich layer positioning of the pocket material (not shown), there enter claws 44 extend from the counter holding plate 43 and rollingly engage or curl therein conforming to the shape of the cavity formed by the inwardly bent outer edge of the male or female parts.

FIG. 25 shows an embodiment in which the male part and the female part, respectively, is the carrier of the claws 44′ which pierce the fabric material, and the retainer plate 43′ has a bent back peripheral edge 45 to receive the claws 44′ in rolled in locking engagement.

Figure 26:
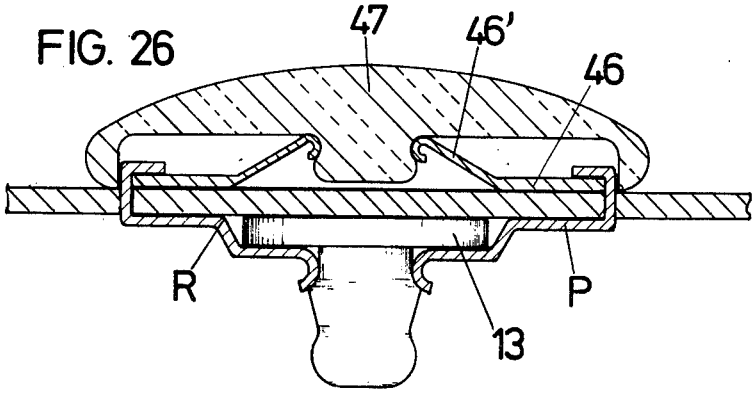
FIG. 26 is a cross-sectional elevational view of a fastener in accordance with the invention used as a snap fastener.

Referring now to FIG. 26, the use of a fastener in accordance with the present invention is illustrated with the aid of a snap fastener; here the collar 13 of the closing head lies in a sunk-in formation of the male part P, whereby a locking engagement between the edge R and the collar 13 can be achieved by a corresponding formation of the sunk-in edge R as well the collar 13 of the closing head.

The counter retainer plate 46′ of this male part P has, as illustrated, a frustoconically shaped elevation 46′ which is provided with a central hole, the peripheral edge of which likewise is inwardly bent around and can serve for the catch locking engagement with an ornamental button part 47.

Figure 27:
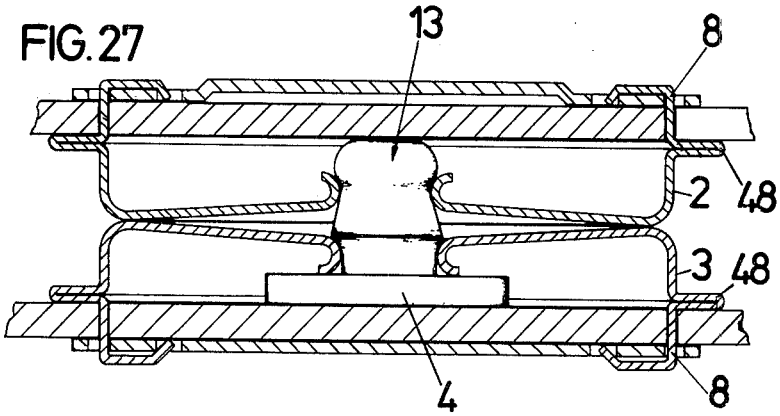
FIG. 27 is a cross-sectional elevational view of a fastener in accordance with the invention in the form of another embodiment.

By the embodiment according to FIG. 27, the fastening sided support surface is enlarged by an outwardly turned stabilizing edge 48 of the male and female parts. The retainer claws 8 extending from the driven-in edge ends are bent on level of the walling of the male part 2 and the female part 3 in the plane of the walling. Further, the retainer claws 8 are hidden from view; even a possible increase of the passage opening of the claws would be hidden by the edge 48.

While we have disclosed several embodiments of the present invention, it is to be understood that these embodiments are given by example only and not in a limiting sense.

We claim:

1. A fastener in the form of a release fastener, snap fastener and the like for pockets, cases and the like, comprising two identically formed female type members, one of said member serving as a female part and formed with an insert opening, a closing head operatively releaseably lockingly engaging in said insert opening, the other of said female type members constituting a male holding part formed with a hold carrying said closing head, said closing head extending through said hole and being formed with a rearward collar supported on said male holding part, means on each of said two female type members, respectively defining said hole of said male holding part and defining said insert opening of said female part, for a plug-in catch connection between said male holding part and said closing head and for a plug-in snap-catch connection between said female part and said closing head, respectively, said closing head comprises a closing head pin formed with two catch grooves disposed one behind the other in a longitudinal direction of said pin, said pin including a center zone of enlarged cross-section separating said two catch grooves from each other, one of said catch grooves lies adjacent said collar and cooperates in a snap-catch connection relationship with an edge range of said hole of said male holding part cooperatively constituting said plug-in snap-catch connection means of said male holding part, the other of said catch grooves is formed adjacent a free end of said pin and cooperates in a locking position of the fastener in a releasable snap-catch locking engagement relationship with an edge range of said insert opening of said female part cooperatively constituting said plug-in snap-catch connection means of said female part, said male holding part and said female part are identically formed and each have a front surface facing each other and an outer peripheral edge, the latter aligned in a common plane with said center zone in the locking position of the fastener, respectively, said front surface of said male holding part and said front surface of said female part are funnel shaped and cooperatively form a trough which widens toward a center point thereof in the locking position of the fastener, and said front surface of said male holding part and said front surface of said female part are clamped abuttingly against each other adjacent said outer edges respectively in the releasable locking position of the fastener by said catch grooves of said closing head engaging with said plug-in snap-catch connecting means of said male holding part and said female part, respectively.

2. The fastener, as set forth in claim 1, wherein said snap-catch connection means for locking engagement relationship of said closing head in a range of said one groove in said edge range of said hole is stronger than said snap-catch connection means for operativy releaseable snap-catch locking engagement relationship between said other catch groove of said closing head and said insert opening of said female part.

3. The fastener, as set forth in claim 1, wherein said snap-catch connection means of said female part and of said male holding part are formed with an inner bent arcuate edge, respectively, forming said insert opening and said hole, and said bent arcuate edge of said insert opening and of said hole cooperate with said catch grooves, respectively of said closing head to form catch means for clampingly pressing said outer edges of both of said parts, respectively, against each other and constitute the releaseable locking engagement position of said closing head in said insert opening.

4. The fastener, as set forth in claim 1, wherein said collar is formed as a bead, adapted to be brought in a path of said plug-in snap-catch connection means, through said hole of said male holding part.

5. The fastener, as set forth in claim 1, wherein said closing head comprises a plurality of parts which are pressed against one another by force of said plug-in snap-catch connection means, said plurality of parts abutting against one another along a longitudinal center plane of said closing head.

6. The fastener, as set forth in claim 1, wherein said closing head comprises two half-parts folded against each other and joined to each other in a longitudinal center plane thereof.

7. The fastener, as set forth in claim 1, further comprising two counter retainer plates each having a plurality of claws adapted to pierce a fabric pocket material, and said male holding part and said female part each have an inwardly bent arcuate outer edge means for securing curlingly therein said plurality of claws of said counter retainer plates with said pocket material sandwiched therebetween.

8. The fastener, as set forth in claim 1, further comprising a counter retainer plate having an arcuately bent outer edge, and said male holding part and said female part, respectively, have a plurality of claw means extending therefrom for being secured in said arcuately bent outer edge.

9. A fastener in the form of a release fastener, snap fastener and the like, for objects, comprising two identically formed female type members each formed with an opening therein, said members each having an outer edge, a closing head including a shank pin formed with two annular catch engagement grooves spaced apart from each other, one of said grooves engaging in catch locking engagement relationship with said opening of one of said members, the other of said grooves engaging in catch locking engagement relationship with said opening of the other of said members, said closing head having an enlarged collar at one end, said collar being larger than said openings, thereby preventing removal of said closing head from said members in one direction, attaching means on said outer edges, respectively, of each of said members, respectively, being directed away from each other in opposite directions for permanently fastening said members, respectively, to the objects.

10. The fastener, as set forth in claim 9, wherein said collar has an end surface abutting one of the objects, said attaching means including claw means for piercing through the latter and fastening thereto.

11. The fastener, as set forth in claim 9, wherein said closing head pin is formed with a cavity extending over a range of at least one of said catch grooves.

12. The fastener, as set forth in claim 9, wherein said closing head pin is formed with a single central cavity extending over a range of both of said two catch grooves.

13. A fastener in the form of a release fastener, snap fastener and the like for pockets, cases and the like, comprising two identically formed female type members, one of said members serving as a female part and formed with an insert opening, a closing head operatively releaseably lockingly engaging in said insert opening, the other of said female type members constituting a male holding part formed with a hole carrying said closing head, said closing head extending through said hole and being formed with a rearward collar supported on said male holding part, means on each of said two female type members, respectively defining said hole of said male holding part and defining said insert opening of said female part, for a plug-in snap-catch connection between said male holding part and said closing head, and for a plug-in snap-catch connection between said female part and said closing head, respectively, two securing counter retainer members adapted to abut one side of a corresponding material, respectively, and each of said female type members have a peripheral edge portion bent in opposite directions relative to each other toward one of said retainer members, respectively, defining a pot shape having therein a pot space, as well as fastening claws extending from said edge portion and securely engaging said retainer member, respectively.

14. The fastener, as set forth in claim 13, wherein said closing head is disposed within said pot space, and said collar abuts the material on a side thereof opposite said retainer plate, said fastening claws piercing through the material.

15. The fastener, as set forth in claim 13, wherein said plug-in snap-catch means of said male holding part and said female part, respectively, are formed by inner arcuately flanged edges of said parts bent in the same respective directions as corresponding of said fastening claws and entering in said pot spaces, respectively, and defining said hole and said insert opening, respectively, of said male holding part and said female part, respectively.

* * * * *